US006581646B2

(12) United States Patent
Dewispelaere

(10) Patent No.: US 6,581,646 B2
(45) Date of Patent: Jun. 24, 2003

(54) THREE-POSITION-JACQUARD MACHINE

(75) Inventor: André Dewispelaere, Kortrijk/Marke (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/021,431

(22) Filed: Dec. 19, 2001

(65) Prior Publication Data

US 2002/0079012 A1 Jun. 27, 2002

(30) Foreign Application Priority Data

Dec. 21, 2000 (BE) ..... 2000/0806

(51) Int. Cl.[7] ..... D03C 13/00
(52) U.S. Cl. ..... 139/455; 139/11; 139/55.1
(58) Field of Search ..... 139/455, 435.1, 139/11, 55.1

(56) References Cited

U.S. PATENT DOCUMENTS

| | | | | |
|---|---|---|---|---|
| 5,193,589 A | | 3/1993 | Seiler | |
| 5,671,784 A | * | 9/1997 | Dewispelaere | 139/455 |
| 5,839,481 A | * | 11/1998 | Bassi et al. | 139/455 |
| 5,862,836 A | * | 1/1999 | Himmelstoss | 139/455 |
| 6,085,803 A | * | 7/2000 | Dewispelaere | 139/455 |

FOREIGN PATENT DOCUMENTS

| | | |
|---|---|---|
| DE | 965570 | 6/1957 |
| DE | 4101778 | 4/1992 |
| EP | 884410 | 12/1998 |
| EP | 930385 | 7/1999 |
| EP | 982419 | 3/2000 |
| JP | 60 173135 | 9/1985 |

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A three-position shed-forming device with a shed-forming element (10);(60,70) in connection with a warp yarn, two lifting devices (1),(2);(41),(42);(51),(52) with a different lifting height (h), **(2*h*) which are movable up and down in phase, and a selection device (20,21); (83,84) (93,94) in order to have the shed-forming element carried along either by the first lifting devices (1);(41);(51) or by the second lifting devices (2);(42);(52) or by none of the lifting devices. A similar device is able to bring, during successive weft insert cycles, a warp yarn alternately into the lower position and in any of the upper, center and lower positions, and has no pulley block elements. A device comprising two shed-forming element (60),(70), both, as described above, working together with a respective set of two lifting devices movable in phase (1),(2); (41),(42); (51),(52) with different lifting heights (h), (2*h*) while the lifting devices of the different sets are movable in opposition, and a pulley block element (103) transmitting the movements of the two shed-forming elements to a warp yarn, is a compact three-position shed-forming device with one pulley block element (103)**.

13 Claims, 2 Drawing Sheets

THREE-POSITION-JACQUARD MACHINE

BACKGROUND OF THE INVENTION

On the one hand, this invention relates to a three-position shed-forming device, comprising a shed-forming element provided to be attached at at least one warp yarn on a weaving machine, one set of lifting means with a first and a second lifting means, which are movable up and down over a different lifting height respectively, and a selection device to selectively influence the shed-forming element, so that it may be carried along or not by a lifting means of the set.

On the other hand, this invention relates to a three-position shed-forming device, comprising two shed-forming elements, pulley block device provided for to transmit the movements of both shed-forming elements to at least one warp yarn on a weaving machine, a set of lifting means with a first and a second lifting means, which are movable up and down over a different lifting height respectively, and a selection device, by means of which each shed-forming element may be influenced selectively, so that it may be carried along or not by a lifting means of the set.

This invention more particularly relates to a three-position-jacquard machine, that is provided with a number of the shed-forming devices, indicated in the first and/or second paragraph in order to form a shed between the warp yarns, during the successive working cycles of the weaving machine, each warp yarn each time being brought into such a position with respect to the path of movement of the weft insertion means of the weaving machine, that these warp yarns and the weft yarns inserted into the shed form the fabric desired, according to the given weaving pattern.

With a three-position-jacquard machine the warp yarns may be brought into three possible positions. Moreover, if all these three positions may be realized at each weft insertion on the weaving machine (this means after each half cycle of movement of the blades), regardless of the previous position, this jacquard machine functions according to the open-shed principle.

In this patent application, the three different positions of the warp yarns are indicated as the upper, center and lower positions.

In the German patent DE 41 01 778 C1 a three-position-jacquard machine is described with shed-forming systems with two hooks working together, which are interconnected by means of a pulley block cord and a pulley block suspended in the down hanging loop of the pulley block cord, which is connected to one or more warp yarns via a harness cord. On selection, each hook may be carried along by a blade moving up and down. Two hooks working together are working together with blades moving in opposite phase respectively.

This machine has three-position shed-forming devices of which two of the hooks working together, when selected, are carried along by blades with a different lifting height respectively. By selecting one hook or the other of a pair of hooks working together the warp yarns may be brought into a center or an upper position via the pulley block. When none of the two hooks is selected, the warp yarns connected to the pulley block remain in their lower position, resting on the bottom plank. With these shed-forming devices the three different positions of the warp yarns cannot be reached after each half cycle of movement of the blades. If the blade with the highest lifting height is in its top dead center the upper or lower positions may be reached. If the other blade is in its top dead center the center of lower positions may be reached.

These shed-forming devices have the disadvantage that it is not possible to realize each of the "upper", "center" or "lower" positions, after having realized the "lower" position after the next half cycle of movement of the blades. Another disadvantage of these shed-forming devices is, that they comprise a pulley block with a pulley block cord. The pulley block cords of a jacquard machine are subject to severe wear because of the friction among them. Moreover, replacing the pulley block cords is time consuming and causes fairly long machine stops.

The jacquard machine from DE-4101778C1 also has three-position shed-forming devices, the two co-operating hooks of which may be carried along by a first and a second blade respectively, each having a same lifting height. The first blade has two hooking on elements provided at a different height, whereas the second blade has only one hooking on element at the level of the upper hooking on element of the first blade. The upper hooking on element is situated near the curved upper extremity of a hook resting on the bottom plank when the first blade is in its bottom dead center. The lower hooking on element is then at a considerably lower level. Therefore one hook is lifted less high when it is carried along by the lower hooking on element than in case when it is carried along by the upper hooking on element. Therefore, depending on the hooking on element chosen, a hook may be brought into two different heights by the first blade, in order to bring the warp yarns in a center position or an upper position. The lower position is realized when both hooks remain in their lowest position on the bottom plank.

Also with these three-position shed-forming devices, the three different positions of the warp yarns cannot be reached after each half cycle of movement of the blades. When the second blade (with one hooking on element) is in its top dead center, only the "upper" and "lower" positions may be reached, when the first blade (with two hooking on elements) is in its top dead center however, the three positions "upper", "center" and "lower" may be reached.

However, these shed-forming devices present the disadvantage that two controls of the selection device are needed, following each other very quickly, in order to select a hook in such a manner, that it is carried along by the lower hooking on element. A first control of the selection device is needed to bring the hook outside the carrier range of the upper hooking on element. A very short time thereafter, when the blade has been lifted a little, a second control of the selection device is needed to bring the hook within the carrier range of the lower hooking on element. These double controls are causing a considerable consumption of energy. The provisions for the energy supply must, of course, be adapted to that high consumption.

A second disadvantage is, that the hooks which are carried along by a lower hooking on element, are picked up by rising blades which are already fairly high above their bottom dead center and therefore are already in full movement. The non too soft contacts between the lower hooking on elements and the hooks will cause shocks in the jacquard machine as a result of which no high weaving speed can be obtained.

SUMMARY OF THE INVENTION

A first objective of this invention is to realize a three-position shed-forming device of the type with which it will be possible to realize each of the "upper", "center" or "lower" positions after having realized the "lower" position for the warp yarns, after the next half cycle of movement of the blades, but without the disadvantages mentioned above of the known jacquard machines, more particularly without the use of pulley block elements and with the possibility to realize each position by only one control of a selection element. A further part of this objective is also to provide for a device with which a three-position open-shed-jacquard machine may be composed, using only one pulley block element.

A known three-position open-shed-jacquard machine is described in the European patent EP 0 399 930. In this jacquard machine each shed-forming device has two pairs of hooks. The hooks of each pair may be carried along by blades moving up and down respectively, after they have been brought into a carrier position by a selection device. The blades working together with a pair of hooks are movable in opposite phase. The hooks of each pair are interconnected by a first and a second pulley block cord respectively which, between the hooks, are passed round under the upper pulley block of a respective pulley block element with an upper and a lower pulley block. A third pulley block cord is attached to one of the extremities in a fixed point and with the other extremity it is connected to a harness cord, which has been provided to determine the position of a warp yarn. From the firmly connected extremity, the third pulley block cord passes over the lower pulley block of the one pulley block element, under a firmly arranged reversing pulley and over the lower pulley block of the other pulley block element successively.

So, in order to bring a warp yarn into three different positions, two pairs of hooks, arranged next to each other with corresponding selection elements are needed. A similar shed-forming device has the disadvantage that it takes up a lot of space. Another disadvantage consists in the fact that for each shed-forming device two selection elements must be controlled, entailing a considerable consumption of energy. Of course, the provisions for the energy supply should be adapted to these circumstances. Moreover each shed-forming device needs three pulley block cords being subject to wear in consequence of the friction among them. The great number of different components (two pulley block elements, a reversing pulley, two selection systems, four hooks) makes this shed-forming device rather complex and expensive.

The device according to EP 0 839 937 is a three-position shed-forming device which takes up less space than the device according to EP 399 930, because four hooks may be carried along two by two by a respective blade and because each hook may be selected by a common selecting element disposed between the pairs of hooks. However, this shed-forming device still requires two pulley block elements and a reversing pulley as well as a number of pulley block cords subject to wear. Moreover, in this case also two selection elements must be controlled.

A second objective of this invention is to provide likewise for a three-position shed-forming device of the type that is able to function according to the open-shed principle, with which the above-mentioned disadvantages of the known three-position open-shed shed-forming device are remedied and which, more particularly, comprises less pulley block elements than the known devices, as for each position only one single control is required.

The objectives mentioned above are obtained by applying the same inventive idea, that consists in making each shed-forming element of the existing devices work together with a first and a second lifting means moving in phase with a different lifting height, and in making it ready to be selected to be carried along by either the one lifting means, or by the other lifting means, or by none of the lifting means at all.

The first objective mentioned above is obtained by carrying out the three-position shed-forming device, with the characteristics mentioned in the first paragraph of this description, in such a manner, that the shed-forming element may be influenced selectively to be carried along either by a first lifting means, or by a second lifting means, and that the first and the second lifting means are movable in phase.

Therefore, the shed-forming element, in each moving cycle of the blades, may be kept either in the lower position or may be brought at a first height by the one lifting means, or may be brought at a second height by the other lifting means. If the shed-forming element is directly connected to a harness cord that, in its turn, is able to position a warp yarn, then this warp yarn may be brought also into three different positions. However, these positions cannot be realized after each half cycle of movement. If the lifting means are in their bottom dead center, only the lower position is realizable. If the lifting means are in their top dead center, each of the three positions may be realized. A similar shed-forming device has not a single pulley block element and therefore no pulley block cords.

Each shed-forming element may be subjected to two selections, resulting in a center position and an upper position respectively. Each selection results in the shed-forming element being carried along by a different lifting means and may therefore be easily realized by two selection means separated from each other. If a different selection element is provided for each selection, then only one single control of the selection element is required for each position. This shed-forming device may be realized in a particularly simple and compact manner and allows for a quick and shock-free operation. As will appear from the following, his shed-forming device may also be used to compose a three-position open-shed shed-forming device, using only one single pulley block element.

According to the invention, the above-mentioned second objective is obtained by applying the same inventive idea, and results in a three-position shed-forming device, having the characteristics mentioned in the second paragraph of this description, in which, for each of the two shed forming-elements a respective set of lifting means with a first and a second lifting means movable in phase is provided for, the lifting means of the one set and the lifting means of the other set being movable in opposition with respect to each other, and each shed-forming element may also be influenced selectively in order to be carried along either by the first lifting means, or by the second lifting means.

A similar shed-forming device allows for a warp yarn on a weaving machine to be brought into each of the three positions after each half cycle of movement of the blades. Each time, one of the sets lifting means is in its top dead center (i.e. after each half cycle of movement) a shed-forming element may be brought at three different heights at will. Because both shed-forming elements together determine the positions of the warp yarns, therefore three different positions of a warp yarn may be realized after each half cycle of movement. This shed-forming device functions according to the open-shed principle and requires only one pair of shed-forming elements, so that it takes up little space (one division) and it has only one pulley block element. This shed-forming device may be built in a compact manner.

Here also, each shed-forming element may be submitted to two different selections, resulting in a center position and an upper position respectively. Each selection results in a shed forming-element, carried along by a different lifting means and may therefore be easily realized by selection means, separated from each other. If for each selection a different selection element is provided, only one single control of a selection element is required for each position. Therefore, this device will consume only little electric energy.

In the most preferred embodiment of the above-mentioned three-position open-shed shed-forming device, the two shed-forming elements are interconnected by a first pulley block cord which, between both shed-forming elements, is passed under the upper pulley block of a pulley block element with two pulley blocks, whereas a second pulley block cord is passed over the lower pulley block of the pulley block element and, on the one hand, is connected to a fixed point with respect to this lower pulley block and, on the other hand, is provided to be connected to one or more warp yarns of a weaving device.

In a preferred embodiment of the shed-forming devices according to this invention the first and the second lifting means of each set comprise a first and a second carrier means respectively, to carry along a shed-forming element, whereas the difference in height between this first and second carrier means is smaller than the difference between the lifting heights of the lifting means, when these lifting means are in their bottom dead center.

As the difference in height between the first and second carrier means (in the bottom dead center of the lifting means) defines the minimal length of the shed-forming elements working together with these lifting means, this characteristic allows for the use of fairly short shed-forming elements. Because of this, the device may be carried out with great compactness, also as to height.

Preferably, each lifting means is provided to carry along the shed-forming element situated in a lower position to an upper position from a height almost coinciding with the bottom dead center of the lifting means concerned. Because of this a shed-forming element is carried along from the beginning of the movement of the lifting means. Because of this the first contact between the lifting means and the shed-forming element passes off without shocks or vibrations. Because of this a quick, efficient shed-forming device is obtained.

If the first and the second lifting means are situated one below the other during their up and down going movement, the device may be built in a very compact manner as to width. Preferably, the first and second lifting means of each pair are situated in a same vertical plane one below the other during their up and down going movement.

Preferably, the lifting height of the first lifting means is almost double the lifting height of the second lifting means. Because of this, the intermediate distance between the upper and the center position of each shed-forming element is almost equal to the intermediate distance between their center and their lower position.

Preferably, the shed-forming devices according to the invention are carried out in such a manner that the selection device may be controlled selectively in order to place a first selection body either in a carrier position, where the shed-forming element may only be carried along by the first lifting means, or in a non-carrier position, where none of the lifting means will be able to carry along the shed-forming element, whereas the selection device may also be controlled selectively in order to place a selection body either in a carrier position, where the shed-forming element may only be carried along by the second lifting means, or in a non-carrier position where none of the lifting means will be able to carry along the shed-forming element.

According to a most preferred embodiment of the devices according to this invention the first and second selection body are part of the shed-forming element. Moreover, these selection bodies are preferably carried out as swivel catches, which may be placed in two different positions by means of an actuator of the selection device, a carrier position and a non-carrier position. Preferably, these shed-forming elements and/or these actuators are carried out as described in the Belgian patent application number 2000/0679.

In a very advantageous embodiment the two positions of each selection body are stable positions.

In an embodiment where the selection device for each selection body comprises an actuator, one single control is enough to select the-shed forming element and this is the case for each position to be realized.

This device is carried out with the greatest possible compactness and with a minimum of parts when it comprises a series of shed-forming elements which are arranged in several rows next to each other, while the selection devices working together with the shed-forming elements of two rows situated next to each other are disposed between these rows, and while a first and a second lifting means is provided between the rows where no selection devices are provided in order to carry along shed-forming elements of both these rows. In that manner each set of lifting means will be able to work together with two rows of hooks, while the selection devices of two rows of hooks are disposed back to back between these rows.

Preferably the selection devices working together with a number of shed-forming elements of two rows situated next to each other are incorporated in a same selection unit. Preferably a similar selection unit is carried out as a separate removable entity.

DETAILED DESCRIPTION OF THE PREFERRED EMBODIMENTS

Now this invention will be further explained by means of the following detailed description of two preferred three-position shed-forming devices according to this invention and of their functioning. The sole intention of this description is to further elucidate the invention by means of an example and to indicate its further advantages and particularities and it should therefore in no way be interpreted as a limitation of the field of application of the invention or of the patent rights claimed in the claims.

In this detailed description reference is made to the attached drawings, of which

Figure 1:
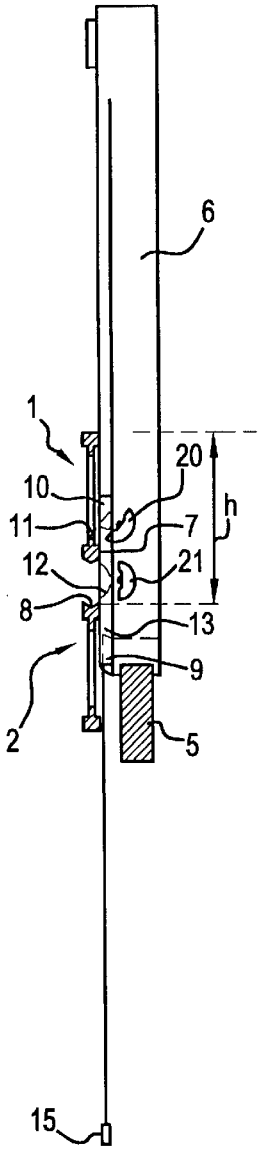
FIGS. 1 through 3 show a schematic side view of one and the same three-position shed-forming device without pulley block elements according to this invention, when realizing a "lower" position (FIG. 1), an "upper" position (FIG. 2) and a "center" position (FIG. 3) respectively.
Figure 2:
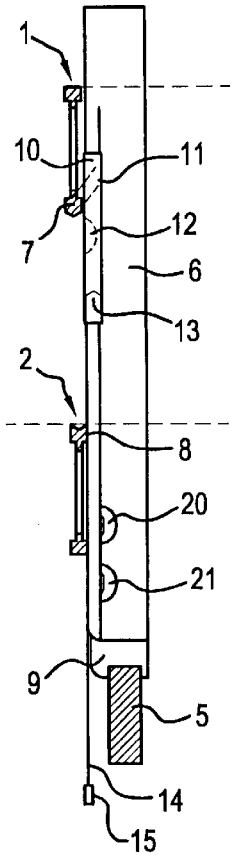
Figure 3:
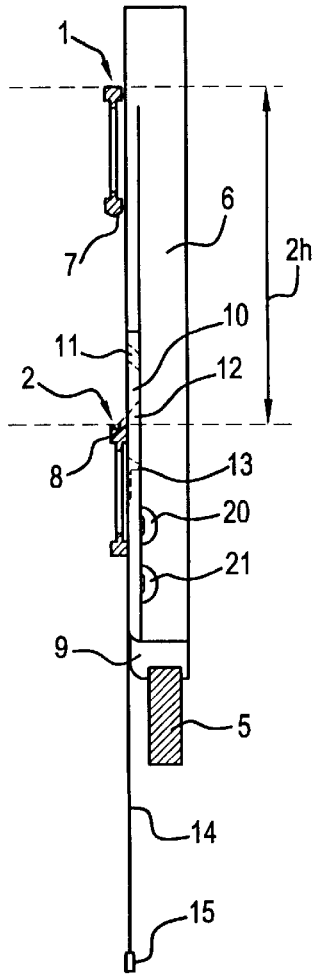

The shed-forming device represented in the FIGS. 1 through 3 is a three-position shed-forming device provided with two lifting blades (1),(2) (to be called hereafter "blades"), situated above each other in a same vertical plane and which may be driven in order to be moved up and down in phase in this plane over a different lifting height (h, 2*h*), between a bottom dead center (see FIG. 1) and a top dead center (see FIGS. 2 and 3). This shed-forming device further comprises a hook (10) with two swivel catches (11), (12) provided one above the other, which may be placed in a stable carrier position and in a stable non-carrier position respectively. The hook (10) may move up and down along a wall (6) carried by a bottom grid (5). The upper blade (1) has a lifting height (2*h*) which is almost double the lifting height of the lower blade (2). The upper (1) and the lower (2) blade each have a carrier edge (7), (8) on which the upper (11) and the lower swivel catch (12) may rest, so that the hook (10) is carried along. On the upper blade (1) this carrier edge (7) is formed by a laterally extending part at the bottom of the blade. On the lower blade (2) this carrier edge (8) is provided at the upper edge of the blade (2). When both blades (1), (2) are in their bottom dead center, the vertical distance between their respective carrier edges (7), (8) is small, and in any case much smaller than the difference between the lifting heights (h), (2*h*) of the blades (1), (2).

Below the swivel catches (11), (12), each hook (10) has a supporting nose (13) with which it may rest on a projection (9) of the wall (6). In that position the upper swivel catch (11) of the hook (10) is almost at the same height as the carrier edge (7) of the upper blade (1) and the lower swivel catch (12) of the hook (10) is almost at the same height as the carrier edge (8) of the lower blade (2), when these blades are in their bottom dead center. Therefore the vertical distance between the two swivel catches (11), (12) of the hook (10) may be almost equal to the fairly small vertical distance between the carrier edges (7), (8) when the blades (1), (2) are in the bottom dead center, so that the hook (10) may be fairly short. At the level of each swivel catch (11), (12) in said wall (6) an actuator (20), (21) is provided to operate the swivel catches (11), (12). Each swivel catch (11), (12) may be placed in a carrier position, the same laterally extending with respect to the hook (10) and may hook on to a carrier edge (7), (8) of a respective blade (1), (2) in order to be carried along by this blade. The upper swivel catch (11) may hook on to the carrier edge (7) of the upper blade (1), while the lower swivel catch (12) may hook on to the carrier edge (8) of the lower blade (2). Each swivel catch (11), (12) may also be placed in a non-carrier position, this swivel catch being mainly situated within the walls of the hook (10) and unable to hook on to a carrier edge. Said carrier position and non-carrier position are stable positions. This means that no energy is needed to maintain these positions. Only for passing from one position to the other energy is needed. To the hook (10) a cord (14) is attached with a suspension point (15) at the bottom for one or more harness cords (not represented in the Figures).

If both swivel catches (11), (12) are in the non-carrier position, the hook (10) will stay down with its supporting nose (13) on the projection (9) in a lower position. The suspension point (15) and therefore a warp yarn too, which is connected to this hook (10) via a harness cord connected to the suspension point (15), will be in a "lower" position.

If the upper actuator (20) is controlled clockwise, the upper swivel catch (11) will come into the carrier position and hook on to the carrier edge (7) of the upper blade (1), so that the hook (10) is carried along by the upper blade (1). When the blade (1) has reached its top dead center (see FIG. 2) the hook (10) has been lifted over a distance (2*h*) which is almost equal to the lifting height (2*h*) of the blade (1). The hook (10) is then in an upper position. The suspension point (15), and a warp yarn connected to the hook (10) via this suspension point, will then be moved upwards over a same distance to reach an upper position.

If however the lower actuator (21) is controlled clockwise, the lower swivel catch (12) will reach the carrier position and hook on to the carrier edge (8) of the lower blade (2), so that the hook (10) is carried along by the lower blade (2). If this blade (2) has reached its top dead center (see FIG. 3), the hook (10) has been lifted over a distance (h) that is almost equal to the lifting height (h) of the lower blade (2). This lifting height (h) is half the lifting height (2*h*) of the upper blade (1), so that the hook (10) has then reached a center position. The suspension point (15), and a warp yarn connected to the hook (10) via this suspension point (15), will then have been moved upwards too over a same distance to a center position.

During the next half cycle of movement of the blades (1), (2), the hook (10) having been carried along by a blade (1), (2) into the upper or center position, is brought back by this blade into the lower position. Also a warp yarn connected to that hook then returns into the "lower" position. So, during successive half cycles of motion of the blades (or during successive weft insertion cycles of the weaving machine) the warp yarns may be brought alternately into the lower position and in any of the upper, center and lower positions. Jacquard machines working according to this principle are preferably used on wire weaving machines for carpet and épinglé machines.

Figure 4:
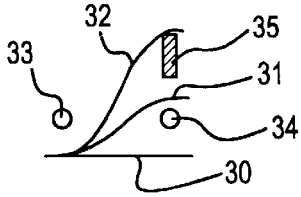
FIG. 4 indicates in a cross-section of a fabric in the direction of the warp yarns, which positions the warp yarns may take up with respect to two successive weft yarns on a rod weaving machine, when using a three-position shed-forming device as represented in the FIGS. 1 through 3, and FIGS. 5 through 7 show a schematic side view of one and the same three-position open-shed shed-forming device with one pulley block element according to this invention, when realizing a "lower" position (FIG. 5), an "upper" position (FIG. 6) and a "center" position (FIG. 7) respectively.

The positions, which three warp yarns (30),(31),32) may take up with respect to two weft yarns (33),(34) having been inserted in successive operating cycles on a rod weaving machine are represented in FIG. 4, which is a cross-section perpendicular to the direction of the weft, on which also a rod (35) is represented.

This shed-forming device has no pulley block elements whatsoever and has none of the disadvantages that go with a pulley block device. From the FIGS. 1 through 3 it may be deduced that the hook may be kept very short and that only two actuators (20), (21) are needed to activate the swivel catches (11), (12). To reach the center or upper position only one actuator has to be activated. Therefore the device will have a low energy consumption. Moreover, controlling is also very simple. A jacquard machine with similar shed-forming devices can also be built in a very compact manner as far as height is concerned. Only one division is required in order to obtain the three positions. So, in a certain depth of the jacquard machine several rows of hooks may be incorporated. This device can deal with a great number of weaves woven on rod weaving machines.

Figure 5:
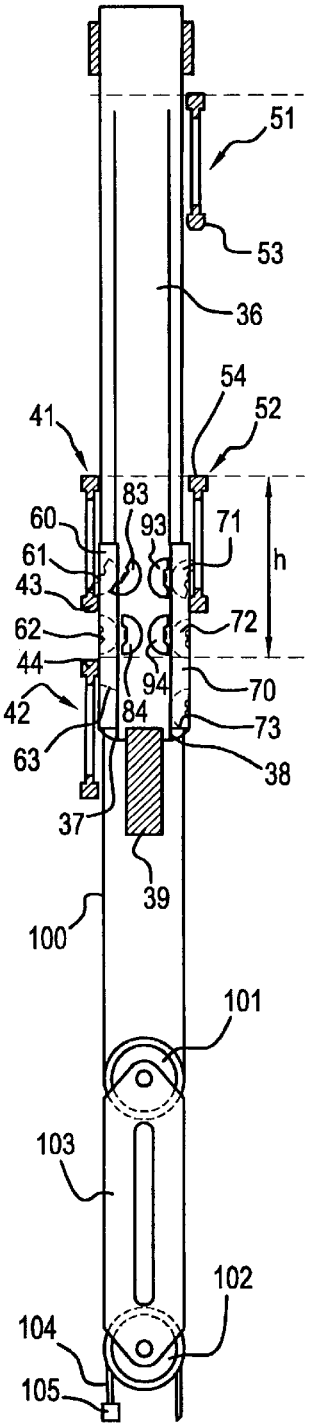
Figure 6:
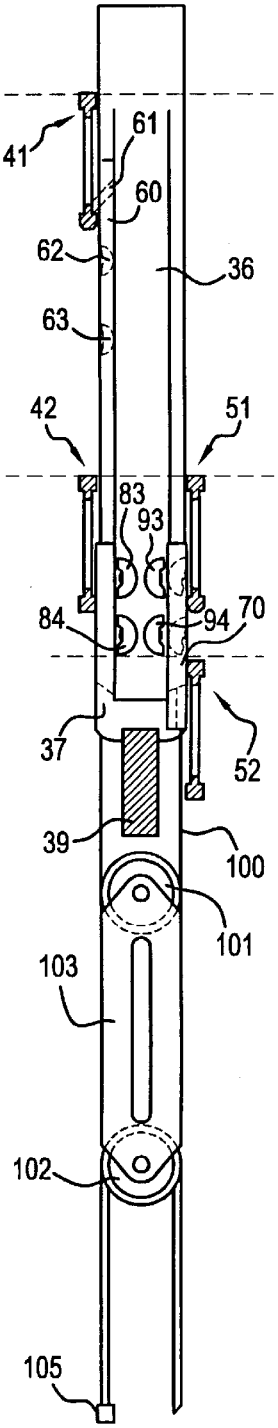
Figure 7:
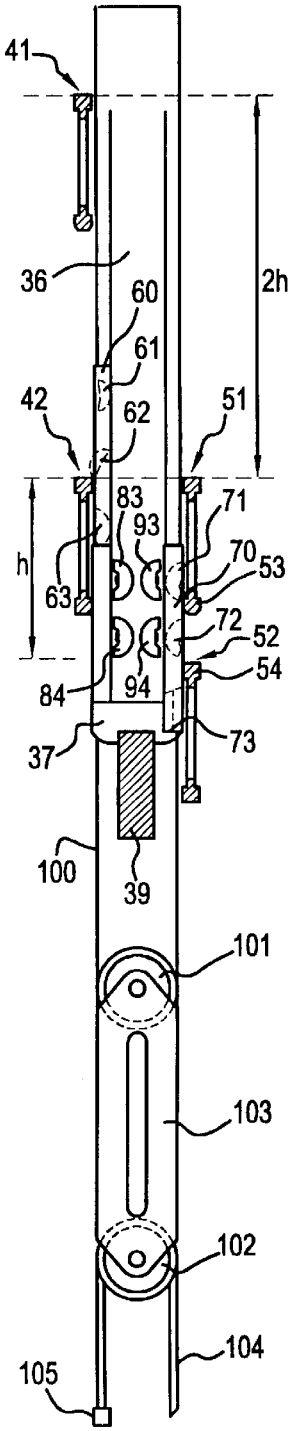

Preferably, the actuators (20), (21) are incorporated in a module, for instance, in a back to back arrangement, so that each pair of blades (1), (2) may serve for two rows of hooks (comparable to what is represented in the FIGS. 5 through 7). Then, on both sides of each module, which is supported by the bottom grid (5), there are two blades (1), (2), one above the other, movable in phase and a hook (10) which may be carried along by these blades. The actuators (20), (21) for each hook (10) are provided in the module. Therefore, the module comprises all selection elements for two rows of hooks (10). Moreover, when this module is easily removable as a whole; replacing selection elements, for instance, in case of a defect, becomes very easy and may be carried out quickly. The wall (6) with the actuators for one single row of hooks (as described above and as represented in the FIGS. 1 through 3) may also be carried out as a removable module.

The shed-forming device represented in FIGS. 5 through 7 is provided with a central module (36) having blades (41), (42);(51),(52) movable in phase, on both sides having a different lifting height (h),(2*h*), which are disposed and function as described above. The upper blades (41),(51) carry out a lifting (2*h*) which is twice the lifting (h) of the lower blades (42),(52). When the blades (41),(42) on one side of the module (36) are in the bottom dead center, the blades (51),(52) on the other side of the module (36) are in the top dead center.

On both sides of the module (36) a hook (60),(61) has been provided. These hooks are carried out as the hook (10) of FIGS. 1 through 3 described above and may be carried along by any of the two blades (41),(42);(51),(52) with which they are working together in the manner described above. The blades (40),(41);(51),(52) have carrier edges (43),(44); (53),(54) which on the upper blades (41),(51) are formed by a lower projecting part and on the lower blades (42), (52) by an upper edge. In each hook (60),(70) two swivel catches (61),(62);(71),(72) are provided each of which may be placed in a carrier position and a non-carrier position by means of a respective actuator (83),(84);(93), (94) provided in the module (36). Each hook (60),(70) also has a supporting nose (63),(73 with which it may rest on a projection (37),(38) of the module (36).

The hooks (60),(70) are connected to a pulley block cord (100). Between the hooks (60),(70) the pulley block cord is passed under the upper pulley block (101) of a pulley block element (103) with an upper (101) and a lower pulley block (102). Over the lower pulley block (102) of this pulley block element (103) a second pulley block cord (104) is passed, which is connected with one extremity to a fixed part (105) of the machine on one side of this pulley block (102) and at the other end (on the other side of the pulley block (102)) has a suspension point (not represented in the figures) for one or more harness cords which are connected to a jacquard lever with a return spring.

In FIG. 5 the left pair of blades (41),(42) is in the bottom dead center and the right pair of blades (51),(52) in the top dead center. With their supporting noses (63),(73), both hooks (60),(70) rest on the projections (37),(38) of the wall of the module (36), which rests on the bottom grid (39). When both swivel catches (61),(62); (71),(72) are placed in the non-carrier position, both hooks (60),(70) remain in this lower position. The pulley block element (103) and therefore the suspension point of the second pulley block cord (104) is therefore also in the lower position. A warp yarn which, via a harness cord, is connected to this suspension point will therefore also be in a lower position.

If the upper actuator (83) of the left hook (60) is controlled clockwise, then the upper swivel catch (61) will hook on to the upper blade (41) of the left pair of blades and the hook (60) will be brought into an upper position by this blade (41) during the next half cycle of movement of the blades with a lifting (2*h*) which is almost equal to the lifting height of the blade (see FIG. 6). Then the pulley block element (103) obtains a lifting (h) which is half the height and the suspension point for the harness of the pulley block cord (104) a lifting (2*h*) which is equal to the lifting of the hook (60). Therefore the jacquard lever connected to the suspension point of the pulley block cord (104) reaches an upper position and the warp yarn connected to it reaches the upper position.

If during the next half cycle of movement, the warp yarns should return to the lower position (at the next weft on a weaving machine), then none of the actuator is activated and the hook (60) will go down again with he upper blade (41) to reach its lower position. Then both hooks are back in the lower position, in which case the warp yarn reaches a lower position.

If the upper position should be maintained, then the upper actuator (93) of the right hook (70) is controlled anti-clockwise in order to bring the accompanying upper swivel catch (71) of this hook into the carrier position. Then the right hook (70) will hook on to the upper blade (51) of the right pair of blades and the hook (70) will be brought upwards with this blade (51), while the left hook (60) is going down. The lifting of the right hook (70) will always be equal to the lowering of the left hook (60). The pulley block cord (100) rolls off in the pulley block element (103) and the pulley block element will remain in its upper position and so will the suspension point of the harness of the pulley block cord (104) and the warp yarn connected to it.

If the center position should be realized from the upper position according to FIG. 6, then the lower actuator (94) of the right hook (70) will be controlled anti-clockwise, so that the lower swivel catch (72) of that hook (70) hooks on to the lower blade (52) of the right pair of blades. The blade (52) carries out a lifting (h) with the right hook (70), whereas the left hook (60) goes back down to the bottom grid (39). The lifting of the right hook (70) is half the lowering of the left hook (60). The result is a lowering of the pulley block element (103), so that the suspension point of the harness of the second pulley block cord (104) reaches a position halfway between the upper and the lower position, so in a center position, the warp yarns also ending up in the center position.

If from the lower position, as represented in FIG. 5, the center position should be reached, then the lower actuator (84) of the left hook (60) will be controlled clockwise in order to make the lower swivel catch (62) of that hook (60) hook on to the lower blade (42) of the left pair of blades. This hook (60) will carry out a lifting (h) with this lower blade (42), because of which it will reach its center position (see FIG. 7). Via the pulley block element (103), the suspension point of the harness. of the second pulley block cord (104) will also be brought upwards with a same lifting (h). Therefore the jacquard lever and the warp yarn connected to it, will reach the center position.

As has been demonstrated for the upper and center position, it may be demonstrated in the same manner, that the same position may also be maintained from the center position, or the two other positions may be reached by the suitable control of only one single actuator (83),(84); (93), (94).

This device functions according to the open-shed principle. Only two short hooks (60), (70) are needed and one pulley block element (103): therefore the device can be very compact as height is concerned and the number of pulley block cords is limited. In order to reach a certain position it will be enough to control only one single actuator (83),(84); (93),(94): therefore the consumption of energy of the device will be low.

I claim:

1. Three-position shed-forming device, comprising a shed-forming element disposed on a weaving machine for contacting at least one warp yarn on the weaving machine, one set of lifting means with a first and a second lifting means movable up and down over a different lifting height respectively, a selection device to selectively influence the shed-forming element, so that the shed-forming element is carried along or not carried along by a lifting means of the one set of lifting means, wherein the shed-forming element is also selectively influenced by the selection device in order to be carried along either by the first lifting means, or by the second lifting means, and wherein the first and the second lifting means are movable up and down in phase.

2. Three-position shed-forming device according to claim 1, wherein the first and the second lifting means of the set comprise a first and a second carrier means to carry along the shed-forming element wherein a difference in height between the first and the second carrier means is smaller than a difference between lifting heights of the first and the second lifting means when the first and the second lifting means are in their bottom dead center.

3. Three-position shed-forming device according to claim 1, wherein each lifting means carries along the shed-forming element being in its lower position to an upper position from a height almost coinciding with a bottom dead center of the lifting means concerned.

4. Three-position shed-forming device according to claim 1, wherein the first and the second lifting means are disposed one above another during up and down movements of the first and the second lifting means.

5. Three-position shed-forming device according to claim 1, wherein a lifting height of the first lifting means is almost double a lifting height of the second lifting means.

6. Three-position shed-forming device according to claim 1, further comprising first and second selection bodies, wherein the selection device is controlled selectively in order to bring the first selection body either into a carrier position when the shed-forming element is carried along only by the first lifting means, or into a non-carrier position when none of the lifting means carries along the shed-forming element, and wherein the selection device is selectively controlled in order to bring the second selection body either into the carrier position when the shed-forming element is carried along only by the second lifting means, or to bring the second selection body into the non-carrier position when none of the lifting means carries along the shed-forming element.

7. Three-position shed-forming device according to claim 6, wherein the first and the second selection body are part of the shed-forming element.

8. Three-position shed-forming device according to claim 6, wherein the carrier position and the non-carrier position are two stable positions of each selection body.

9. Three-position shed-forming device according to claim 6, wherein the selection device for each selection body comprises an actuator.

10. Three-position shed-forming device according to claim 1, further comprising a series of shed-forming elements arranged in several rows situated next to each other, in that the selection devices working together with the shed-forming elements of two rows situated next to each other are disposed between the two rows, and that between the rows where no selection devices have been provided, the first and the second lifting means are provided in order to carry along shed-forming elements of the two rows.

11. Three-position shed-forming device according to claim 1, wherein the selection devices working together with a number of shed-forming elements of two rows situated next to each other are incorporated in a same selection unit.

12. Three-position shed-forming device comprising two shed forming elements, a pulley block device provided to transmit the movements of both shed-forming elements to at least one warp yarn on a weaving machine, a set of lifting means with a first and a second lifting means which are movable up and down over a different lifting height respectively, and a selection device with which each shed-forming element is influenced selectively, so that the shed-forming element is carried along or not carried along by a lifting means of the set, characterized in that for each of the two shed-forming elements, a respective set of lifting means with the first and the second lifting means movable in phase is provided, in that the lifting means of the one set and the lifting means of the other set are mutually movable in opposition, and in that each shed-forming element is also selectively influenced in order to be carried along either by the first lifting means, or by the second lifting means.

13. Three-position shed-forming device according to claim 12, wherein the two shed-forming elements forming a pair are interconnected by a first pulley block cord, which is passed between the two shed-forming elements under an upper pulley block of a pulley block element with two pulley blocks, whereas a second pulley block cord is passed over a lower pulley block of the pulley block element and the lower pulley block is connected to a fixed point and to one or several warp yarns on the weaving machine.

* * * * *